United States Patent [19]

Kuhn et al.

[11] Patent Number: 4,765,544

[45] Date of Patent: Aug. 23, 1988

[54] ELECTROSTATIC SPRAY GUN

[75] Inventors: Wolfgang Kuhn, Schloss Holte; Karl Rapp, Auenwald, both of Fed. Rep. of Germany

[73] Assignee: Kopperschmidt-Mueller GmbH & Co. Kg, Bielefeld, Fed. Rep. of Germany

[21] Appl. No.: 4,188

[22] Filed: Jan. 15, 1987

[30] Foreign Application Priority Data

Jan. 16, 1986 [DE] Fed. Rep. of Germany ..... 3601081

[51] Int. Cl.[4] ..... B05B 5/02

[52] U.S. Cl. ..... 239/698; 239/706

[58] Field of Search ..... 239/295, 296, 297, 298, 239/299, 704, 705, 706, 707, 698, 697

[56] References Cited

U.S. PATENT DOCUMENTS

| | | | |
|---|---|---|---|
| 2,966,310 | 12/1960 | Sedlacsik | 239/697 |
| 3,608,823 | 6/1970 | Buschor | 239/698 |
| 3,903,321 | 9/1975 | Schaad | 239/698 |
| 4,216,915 | 8/1980 | Hengartner et al. | 239/698 |
| 4,380,320 | 4/1983 | Hollstein et al. | 239/704 |
| 4,508,265 | 4/1985 | Jido | 239/696 |
| 4,548,363 | 10/1985 | McDonough | 239/698 |
| 4,630,777 | 12/1986 | Hollstein et al. | 239/698 |

FOREIGN PATENT DOCUMENTS 3412694 10/1984 Fed. Rep. of Germany .

*Primary Examiner*—Andres Kashnikow
*Assistant Examiner*—C. Trainor
*Attorney, Agent, or Firm*—Peter K. Kontler

[57] ABSTRACT

An electrostatic spray gun wherein the barrel is formed by two tubes which define an annular gap for gaseous or pulverulent material. An electrode is installed in the inner tube between the front and rear ends of such tube and has two or more prongs extending outwardly into the gap. The central portion of the electrode has one or more discharging portions in a path for the flow of pulverulent or gaseous material toward a deflector which is releasably mounted at the front end of the inner tube. The electrode is connected with a high-voltage conductor which is mounted in a tubular shield within the inner tube.

22 Claims, 2 Drawing Sheets

(A-A)

ELECTROSTATIC SPRAY GUN

CROSS-REFERENCE TO RELATED CASE

An electrostatic spray gun which is somewhat similar to the spray gun of the present invention is disclosed in the commonly owned copending patent application Ser. No. 942,164 filed Dec. 16, 1986 for "Portable electrostatic spray gun". The disclosure of the copending application is incorporated herein by reference.

BACKGROUND OF THE INVENTION

The invention relates to improvements in electrostatic spray guns, especially for spraying pulverized or pulverulent coating materials. More particularly, the invention relates to improvements in electrostatic spray guns of the type wherein the barrel comprises inner and outer tubes defining an annular clearance for the flow of a liquid, gaseous or flowable solid material toward a deflector at the front end of the inner tube and wherein an electrode is connected with a high-voltage conductor which is installed in the inner tube of the barrel.

German Offenlegungsschrift No. 34 12 694 of Kirchner et al. discloses an electrostatic spray gun wherein the annular clearance between the inner and outer tubes of the barrel serves for admission of a mixture of air and pulverulent material. The front end of the inner tube of the barrel extends forwardly beyond the front end of the outer tube and is provided with a circumferential groove for a stream of swirling control air. Ionization is effected by means of a third air stream which is admitted through an axial channel in the inner tube and is diverted radially outwardly through a conical gap at the front end of the inner tube to enter the mixture of air and pulverulent material issuing from the front end of the annular clearance between the inner and outer tubes. A disc-shaped electrode constitutes a portion of the boundary for the conical gap. The ionization of flowable materials in such types of spray guns is not entirely satisfactory.

Applicants are further aware of the disclosure of U.S. Pat. No. 4,548,363 to McDonough which deals with a muzzle for electrostatic spray guns and with the manner of connecting a conductive rod in a tube of the muzzle with a power terminal.

OBJECTS AND SUMMARY OF THE INVENTION

An object of the invention is to provide an electrostatic spray gun whose ionizing action is more satisfactory than those of conventional spray guns.

Another object of the invention is to provide a novel and improved barrel for use in the above outlined spray gun.

A further object of the invention is to provide a novel and improved electrode for use in the above outlined spray gun.

An additional object of the invention is to provide novel and improved conductor means for connecting the electrode with a source of high-voltage electrical energy.

Still another object of the invention is to provide novel and improved means for maintaining the conductor means in contact with the electrode.

A further object of the invention is to provide novel and improved means for connecting the deflector with the barrel of the above outlined electrostatic spray gun.

The invention is embodied in an electrostatic spray gun which can be used with particular advantage for spraying a pulverized or pulverulent coating material. The spray gun comprises a barrel having inner and outer tubes which define an annular clearance, means (e.g., a conduit) for admitting a flowable (pulverulent or gaseous) material into the clearance, a high-voltage conductor in the inner tube, and an electrode which is provided in and is disposed between the front and rear ends of the inner tube. The electrode has at least two tips which extend outwardly though the inner tube and are spaced apart from each other in the circumferential direction of the inner tube.

The front end of the inner tube extends, or can extend, forwardly beyond the front end of the outer tube, and the electrode can be installed in the inner tube between the front ends of the inner and outer tubes.

The inner tube is provided with a channel, and the electrode can comprise at least one electrical discharge portion in the channel. Such spray gun further comprises means for admitting a flowable (gaseous or pulverulent) material into the channel.

The conductor can comprise a terminal which is adjacent the electrode, and resilient means for biasing the terminal toward the electrode. A tubular shield can be provided for the conductor in the channel of the inner tube, and the conductor can further comprise at least one rod-like portion which contacts the terminal and is biased against the latter axially of the inner tube by the aforementioned resilient means. The terminal can be mounted on or in the shield. If the conductor comprises several rod-like portions, they are preferably disposed end-to-end between the terminal and the biasing means, and at least one of the rod-like portions can comprise or constitute a limiting resistor. The shield and the inner tube can define an annular clearance or gap for the flow of a second flowable material toward the front end of the inner tube.

The peripheral surface of the inner tube can be provided with recesses for the tips of the electrode.

The tips of the electrode can but need not be equidistant from each other in the circumferential direction of the inner tube.

The electrode can comprise a plurality of wires which define the aforementioned tips. Such wires can extend into and through substantially radially disposed openings in the inner tube. Alternatively, the electrode can be made of metallic sheet material and the tips then constitute or are provided on the prongs of the electrode.

A deflector is provided at the front end of the inner tube. Such deflector can comprise a substantially disc-shaped body which is outwardly adjacent the front end of the inner tube, and a carrier which supports the disc-shaped body and extends into a socket in the front end of the inner tube. The carrier and the front end of the inner tube define an annular passage for the flow of the second flowable material against the disc-shaped body. The carrier preferably comprises means for holding the disc-shaped body by snap action; to this end, the front portion of the carrier can constitute a resilient holder for the disc-shaped body. The front end of the inner tube and the carrier can comprise cooperating male and female detent means for releasably holding the carrier in the socket.

The novel features which are considered as characteristic of the invention are set forth in particular in the appended claims. The improved spray gun itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
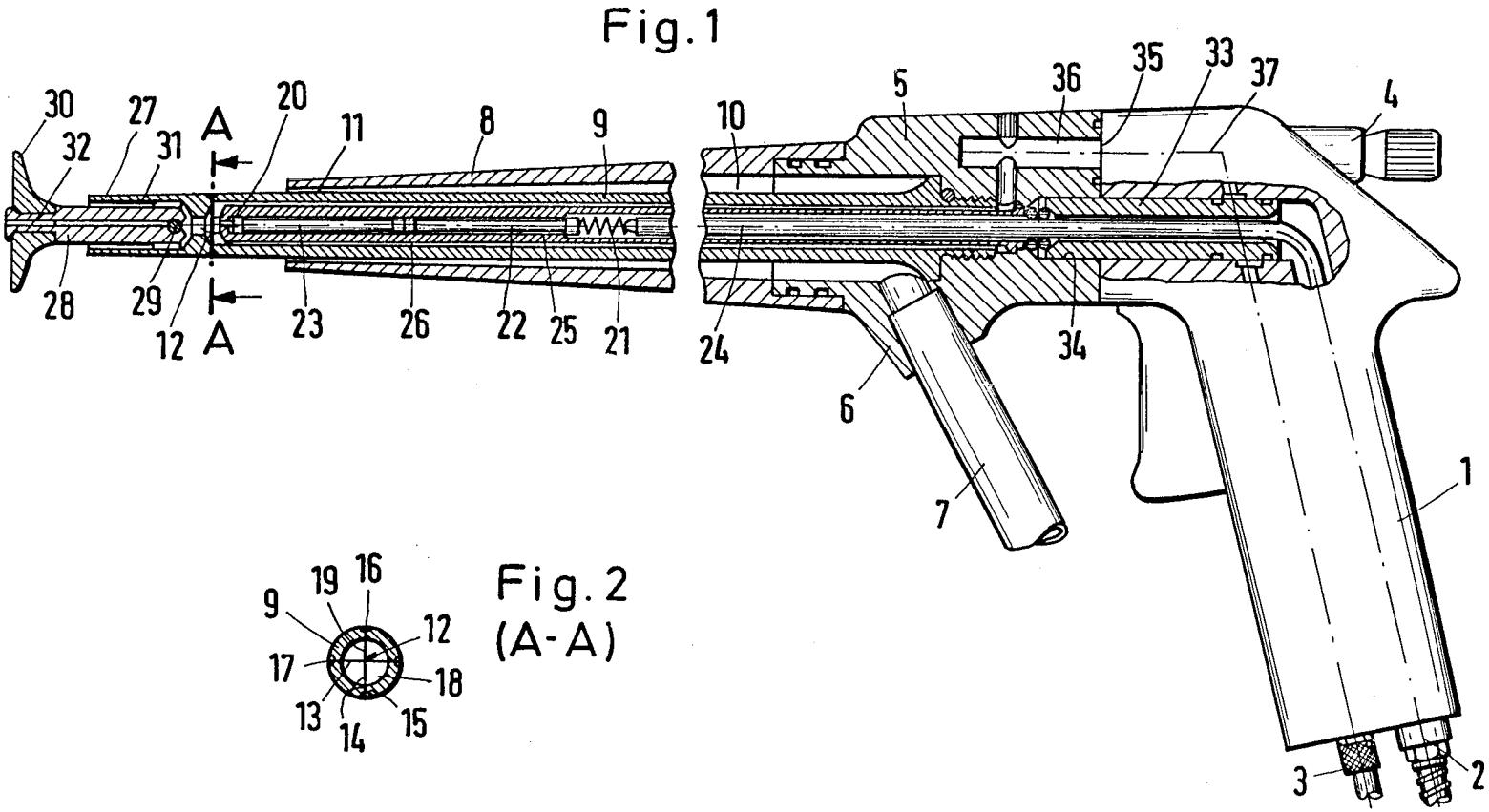
FIG. 1 is a fragmentary partly elevational and partly central longitudinal sectional view of a portable spray gun which embodies one form of the invention.
FIG. 2 is a sectional view as seen in the direction of arrows from the line A—A of FIG. 1.

FIGS. 1 and 2 show a portable electrostatic spray gun which comprises a grip 1 with a high-voltage cable 2 connectable to a suitable energy source, not shown. The grip 1 is further connected with a conduit 3 which admits compressed air into a path wherein the flow of air is controlled by an adjustable flow restrictor 4 mounted at the top of the grip 1. The grip 1 includes a handgrip portion with a trigger (not referenced) and a front portion 5 which is separable from the handgrip portion in a plane 35. The front portion 5 has an inlet 6 which is connected with the discharge end of a supply conduit 7 for admission of a pulverulent material or a mixture of pulverulent material and air. The front portion 5 of the grip 1 is further connected with a composite barrel having an inner tube 9 and an outer tube 8. The tubes 8 and 9 define an annular clearance or gap 10 which receives the mixture of air and pulverulent material from the inlet 6 of the front portion 5. The front end 11 of the clearance 10 discharges an annular stream of pulverulent material which advances forwardly toward the rear side of the disc-shaped body 30 of a composite deflector mounted at the front end of the inner tube 9.

The barrel including the tubes 8 and 9 supports a cruciform electrode 12 which includes two intersecting wires 13 and 14. The wires are disposed in the inner tube 9 and extend radially outwardly through suitable openings 15 which are provided therefor in the tube 9. The median portions of the wires 13, 14 (where the two wires cross each other) can but need not necessarily be connected to each other. The radially outermost portions or tips 16 of the wires 13, 14 extend into shallow recesses or notches 17 which are provided in the peripheral surface of the inner tube 9. The purpose of the tips 16 of the wires 13, 14 is to effect a corona discharge in the annular stream of the mixture of air and pulverulent material which flows from the inlet 6 of the front portion 5 of the grip 1 toward and beyond the front end 11 of the clearance 10 between the tubes 8 and 9. The purpose of the recesses 17 is to ensure that the tips 16 of the wires 13, 14 (i.e., of the electrode 12) need not extend well beyond the inner tube 9. Each of the recesses 17 is or can be bounded by a substantially hemispherical surface. Those portions (19) of the wires 13, 14 which are more or less loosely received in the interior of the inner tube 9 serve as a discharging means so as to ionize air in the stream flowing from the flow restrictor 4 toward the front end of the inner tube 9.

The central portion of the electrode 12 (at the intersection of the wires 13 and 14) is contacted by a terminal 20 which is biased by a resilient element in the form of a coil spring 21 through the medium of two rod-like portions 22, 23 forming extensions of a rigid high-voltage conductor 24 extending from the cable 2 to the electrode 12, in part through the grip 1 and in part through the axial channel 18 of the inner tube 9. The rod-shaped bodies 22, 23 are or can constitute limiting resistors. The spring 21 reacts against the front end face of the rigid conductor 24 and bears against the adjacent end face of the rear resistor 22. The resistors 22 and 23 are installed in a tubular shield 25 which has an externally threaded rear end portion mating with a complementary internally threaded portion of the front portion 5 of the grip 1. The shield 25 constitutes a guide in which the resistors 22 and 23 are movable axially.

The outer diameter of the shield 25 is smaller than the inner diameter of the inner tube 9 so that these parts define an annular clearance or gap 26 wherein the stream of air can flow from the flow restrictor 4 toward the composite deflector at the front end of the inner tube 9. Such air is supplied by the conduit 3. The stream of air cools the shield 25 as well as the resistors 22 and 23.

The front end of the inner tube 9 extends forwardly beyond the front end of the outer tube 8 and is formed with a socket 27 for a shank- or stud-like carrier 28 of the disc-shaped body 30 of the composite deflector. The foremost portion of the carrier 28 is preferably elastic (e.g., as a result of the provision of diametrically extending slots therein) so that the median portion of the disc-shaped body 30 can be readily snapped onto or detached from the foremost portion, e.g., for the purposes of cleaning.

The periphery of the shank-like carrier 28 is preferably formed with axially parallel flutes so as to provide several paths for the flow of ionized air from the front end of the gap 26, by way of a flow restrictor in front of the electrode 12 and on toward the rear side of the disc-shaped body 30.

The socket 27 contains a transversely extending wire-like male detent element 29 whose end portions are anchored in the inner tube 9 and which can snap into a complementary female detent element constituted by the rear end portion of the carrier 28. To this end, the rear end portion of the carrier 28 can be slotted crosswise so as to enable the male detent element 29 to penetrate into the transversely extending passage which is provided therefor in the carrier 28. Thus, the carrier 28 can be readily extracted from the socket 27 and the disc-shaped body 30 can be readily detached from the carrier. The carrier 28 and the front end of the inner tube 9 (around the socket 27) define a substantially annular passage 31 for the flow of ionized air against the rear side of the disc-shaped body 30. The front end of the annular stream of air issuing from the passage 31 is deflected radially outwardly as a result of impingement upon the body 30 and is thereby caused to penetrate into the annular stream of pulverulent material which issues from the front end 11 of the annular gap 10 between the tubes 8 and 9. This ensures the development of a predictable cloud of pulverulent material. The axial hole or bore 32 of the carrier 28 can admit (if and when necessary) some of the ionized air into the space in front of the disc-shaped body 30 (i.e., to the left of the composite deflector, as seen in FIG. 1). The purpose of such air is to cleanse or rinse the space immediately in front of the body 30.

The grip 1 contains a sleeve 33 which extends forwardly beyond the plane 35, i.e., from the handgrip portion into the front portion 5 of the grip 1. The front portion 5 has a complementary recess or bore 34 for the protruding part of the sleeve 33. One or more bolts, screws or other suitable fasteners (not shown) are provided to releasably secure the front portion 5 to the handgrip portion of the grip 1. The connection is such that an air channel 36 in the front portion 5 communicates with an air channel 37 in the rear or handgrip portion of the grip 1. The flow restrictor 4 controls the flow of air in the channel 37. Suitable sealing means (e.g., one or more O-rings or the like) can be recessed into the surfaces bounding the plane 35 to prevent any uncontrolled escape of air in the region where the portions of the grip 1 abut each other.

The desirable satisfactory ionization of pulverulent material is accomplished in that the electrode 12 has four preferably equidistant tips 16 which extend into or close to the path of flow of pulverulent material beyond the front end of the outer tube 8 of the composite barrel. In addition, the central portion or portions 19 of the electrode 12 ionize the stream of air which flows through the channel 18 of the tube 9 and on toward the socket 27. Each tip 16 effects a corona discharge.

An important advantage of the improved spray gun is that the ionizing of material which is to be sprayed is more satisfactory than in conventional apparatus. This is attributable to the provision of an electrode 12 with several tips 16 which extend into the path of advancement of material beyond the front end of the gap 10. In addition, the stream of air which flows through the channel 18 of the inner tube 9 is also ionized so that the combined ionizing action upon the material which is to be used for coating is highly satisfactory. In conventional spray guns, the electrode brings about ionization of the air stream, and the ionized air stream thereupon acts upon the flow of pulverulent material without any prior ionizing of pulverulent material.

Another advantage of the improved spray gun is that it can employ a very simple and inexpensive electrode which can be installed in a simple and time-saving manner. It suffices to establish a single point of contact between the central portion of the electrode and the high-voltage conductor; this provides a connection between the energy source and each and every tip 16 of the electrode.

The electrode 12 can be installed between the two ends of the inner tube 9 in such location that it is disposed within the confines of the outer tube 8. However, and as shown in FIG. 1, it is also possible to install the electrode 12 between the front end of the outer tube 8 and the front end of the inner tube 9. Of course, the electrode will have to be installed behind the front end of the outer tube if the front end of the inner tube does not extend beyond the outer tube. The mounting of electrode 12 in a manner as shown in FIG. 1 is preferred in many instances because the electrode can be located in an air stream whose speed has been reduced as a result of advancement from the relatively narrow annular clearance 26 between the shield 25 and the internal surface of the inner tube 9 into the enlarged space in front of the shield 25. Moreover, the shield 25 cannot interfere with propagation of the electrostatic field and corona discharges at the tips 16 of the wires 13 and 14.

A further advantage of the improved spray gun is that a single electrode suffices to ensure a desirable ionization of several streams of flowable material which advance toward the deflector. Thus, the tips 16 extend into the stream which flows beyond the annular gap 10 while the central portions 19 of the wires ionize the stream in the channel 18 of the inner tube 9.

The illustrated composite high-voltage conductor 24, 21, 22, 23, 20 constitutes a desirable but optional feature of the improved spray gun. The spring 21 renders it possible to establish a proper connection between the energy source and the electrode 12 even when the spray gun is subjected to rough treatment and even if the parts of the connection between the energy source and the electrode are not machined and/or otherwise finished with a high degree of precision (i.e., the spring 21 can compensate for machining and other manufacturing tolerances). The bias of the spring 21 can be adjusted and selected with a view to ensure the establishment of a reliable electrical connection under the contemplated operating conditions. Installation of the electrode 12 in the tubular shield 25 simplifies the assembly of the spray gun; moreover, the shield 25 serves as a simple but effective guide means for the rod-shaped resistors 22, 23. Limiting resistors are presently preferred rod-like portions of the high-voltage conductor. The shield 25 performs the additional desirable function of contacting the air stream in the clearance 26 so that it can exchange heat with the flowing air and thereby cool the electrode 12 and the rod-shaped resistors 22, 23. Still further, the gap 26 which is defined by the shield 25 and the internal surface of the inner tube 9 ensures that the annular air stream is not directed exactly against the center of the electrode 12 but rather against the portions 19 of the wires 13, 14 which are nearer to the internal surface of the tube 9; this promotes the ionizing action of the electrode.

The recesses 17 are optional but desirable. They ensure that the tips 16 of the wires 13 and 14 need not extend well into the stream of pulverulent material which has advanced beyond the front portion 11 of the annular gap 10. In fact, it often suffices to dimension the wires 13 and 14 in such a way that the tips 16 remain confined in the respective recesses 17, i.e., that such tips do not extend beyond the major (cylindrical) portion of the peripheral surface of the inner tube 9.

Figure 3:
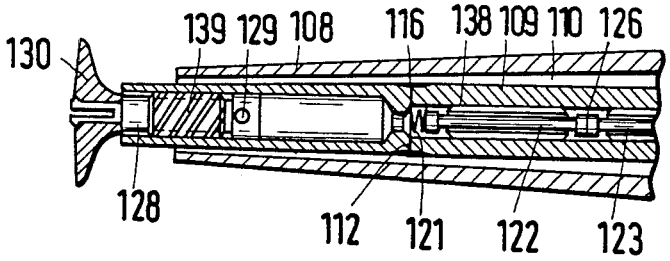
FIG. 3 is a central longitudinal sectional view of a first portion of a modified spray gun.
Figure 4:
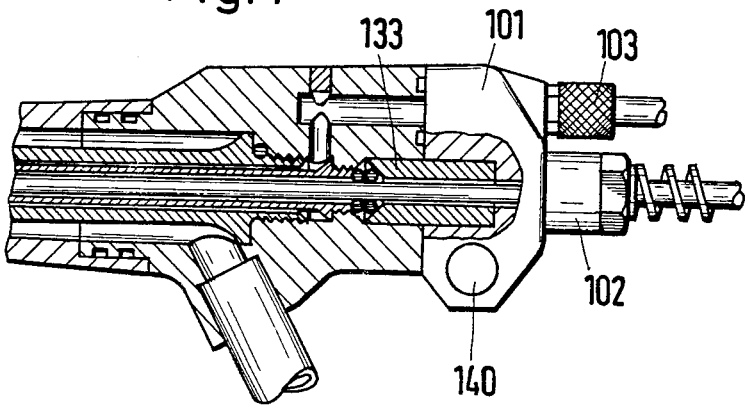
FIG. 4 is a similar fragmentary longitudinal sectional view of a second portion of the modified spray gun.

FIGS. 3 and 4 show portions of a modified spray gun which is not or need not be of the portable type. All such parts of this spray gun which are identical with or clearly analogous to the corresponding parts of the spray gun of FIGS. 1–2 are denoted by similar reference characters plus 100. The wire-like electrode 112 again comprises tips 116 which, however, extend into the annular clearance or gap 110 between the inner and outer tubes 109, 108 of the composite barrel. In this embodiment of the spray gun, the coil spring 121 is in direct contact with the electrode 112, i.e., the terminal 20 of FIG. 1 can be omitted. The rear resistor 123 of the file of discrete resistors 122, 123 abuts directly the rigid portion of the high-voltage conductor which extends from the handle 101 at 102 (FIG. 4). The tubular shield 25 of FIG. 1 is not provided. Instead, the resistors 122, 123 have axially parallel peripheral flutes so as to allow compressed air to flow from the conduit 103 toward and beyond the electrode 112 by way of the axial channel in the inner tube 109.

The carrier 128 of the composite deflector at the front end of the inner tube 109 is provided with an air twisting or swirling device 139 having one or more helical grooves.

The handle 101 of FIG. 4 can be replaced with a pistal grip 1 so that the spray gun of FIGS. 3–4 can be used as a portable implement or as an automatic spray gun. The handle 101 has a transversely extending hole 140 which can receive a rod-like or otherwise configurated support for attachment of the holder 101 to a stationary member, not shown.

The carrier 28 of FIG. 1 can also comprise means for swirling the air stream which is delivered by way of the axial channel 18 in the inner tube 9.

Figures 5, 6, 7, 8, 9:
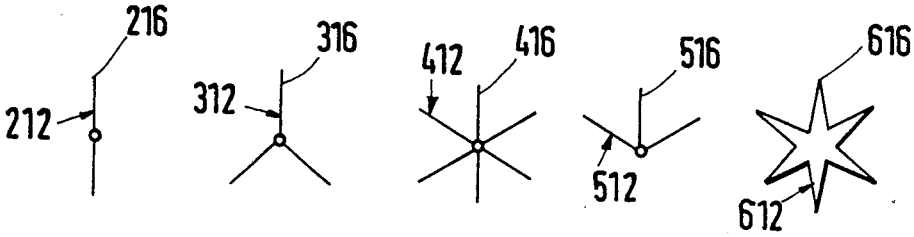
FIG. 5 is a front elevational view of one form of an electrode which can be used in the improved spray gun.
FIG. 6 is a similar view of a modified electrode with three equidistant tips.
FIG. 7 is a similar view of a further electrode with six tips.
FIG. 8 is a similar view of an electrode which constitutes a modification of the electrode of FIG. 6.
FIG. 9 is a front elevational view of a star-shaped electrode which is made of metallic sheet material.

FIG. 5 shows a modified electrode 212 which comprises a single straight wire with two tips 216. This electrode can be used with advantage for certain spraying operations when the application of pulverulent material should be more pronounced in certain areas and less pronounced in other areas.

If the spray gun is to discharge a flat stream of pulverulent material, the operator may wish to decide to place the electrode into the plane of the flat stream or into a plane which extends at right angles (or at another selected angle) to the plane of the flat stream.

FIG. 6 shows a three-pronged wire electrode 312 with three equidistant corona discharge tips 316, and FIG. 7 shows an electrode 412 with six equidistant tips 416 (as considered in the circumferential direction of the inner tube, not shown in FIG. 7).

FIG. 8 shows an electrode 512 wherein the acute angle between the central wire and the left-hand wire is or can be the same as the acute angle between the central wire and the right-hand wire; however, the angle between the two outer wires is an obtuse angle. One of the tips is shown at 516. Such distribution of wires in an electrode (512) is desirable and advantageous when the coating action at a particular location must be much more pronounced than elsewhere.

It is clear that the electrodes of FIGS. 1–8 constitute but a few examples of wire-like electrodes which can be used in the spray gun of the present invention. The number of wires can be increased above the illustrated numbers without departing from the spirit of the invention. By way of example, the electrode 512 of FIG. 7 can be made from three straight wires each having two tips which extend into discrete openings provided therefor in the wall of the inner tube, such as the tube 9 of FIG. 1. The median portions of the three discrete wires need not be connected to each other. Alternatively, and as shown in FIG. 7 by a circle, the central portions of the three wires can be welded, soldered or otherwise permanently connected to one another. Such bonding is desirable if the surfaces surrounding the openings for discrete wires cannot ensure reliable retention of the wires in selected positions.

FIG. 9 shows a star-shaped electrode 612 which is made from a metallic sheet material and has six equidistant prongs with pointed tips 616. If the inner tube of the barrel is made from a plastic material, the electrode 612 can be permanently embedded in the plastic material of the inner tube in an injection molding, extruding or like machine.

In most or many instances, the tips of the electrode will be equidistant from each other, as seen in the circumferential direction of the inner tube. However, and as shown in FIG. 8, an asymmetric distribution of tips (516) is not only possible but can be quite useful under certain circumstances. The ionization pattern is particularly uniform if the electrode comprises a relatively large number of corona discharge portions.

The deflector ensures an intensive intermixing of the ionized air stream with ionized pulverulent material outside of the inner tube 9. Exchangeability of the deflector is desirable and advantageous for the previously discussed reasons as well as because the operator can readily replace the previously used deflector with a different deflector which is more suitable for a particular type of spraying operation. It often suffices to merely detach the disc-shaped body 30 from the carrier 28. Alternatively, the operator will detach the entire composite deflector 28, 30, for example, if the carrier of a fresh deflector is to allow a larger or smaller quantity of ionized air to flow beyond the socket 27.

The invention can be embodied with similar advantage in spray guns which are used for the application of liquid materials. In such spray guns, the liquid medium is preferably admitted into the central channel of the inner tube whereas the dispersing and/or control air flows through the annular clearance or gap between the inner and outer tubes.

It is further possible to use the improved spray gun for multicomponent spraying. Thus, one of the components (e.g., a first liquid material) can be admitted by way of the annular gap between the inner and outer tubes of the barrel and the other component (such as a second liquid material) can be admitted by way of the channel in the inner tube.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An electrostatic spray gun, particularly for pulverized coating material, comprising a barrel having inner and outer tubes defining an annular gap, said inner tube having a front and a rear end; means for admitting a flowable material into said gap; a high-voltage conductor in said inner tube; and an electrode connected with said conductor, said electrode being disposed between the front and rear ends of said inner tube, and said electrode having a portion inside said inner tube and at least two tips extending outwardly from said portion through said inner tube, said tips being exposed at the exterior of said inner tube and being spaced apart from each other in the circumferential direction of said inner tube.

2. The spray gun of claim 1, wherein said outer tube has a front end and the front end of said inner tube extends forwardly beyond the front end of said outer tube, said electrode being disposed between the front ends of said inner and outer tubes.

3. The spray gun of claim 1, wherein said inner tube has a channel and said portion constitutes an electrical discharge portion located in said channel; and further comprising means for admitting a second flowable material into said channel.

4. The spray gun of claim 3, wherein said conductor comprises a terminal adjacent said electrode and resilient means for biasing said terminal toward said electrode.

5. The spray gun of claim 4, further comprising a tubular shield for said conductor in said inner tube, said conductor further comprising a rod-like portion which contacts said terminal, said resilient means including means for biasing said rod-like portion toward said electrode in the axial direction of said inner tube.

6. The spray gun of claim 5, wherein said terminal is mounted in said shield.

7. The spray gun of claim 5, wherein said conductor comprises a plurality of rod-like portions which are disposed end-to-end between said terminal and said resilient means.

8. The spray gun of claim 5, wherein said rod-like portion comprises a resistor.

9. The spray gun of claim 5, wherein said shield and said inner tube define an annular clearance for the flow of the second flowable material toward the front end of said inner tube.

10. The spray gun of claim 1, wherein said inner tube has a peripheral surface and recesses provided in said peripheral surface for the tips of said electrode.

11. The spray gun of claim 1, wherein the tips of said electrode are equidistant from one another in the circumferential direction of said inner tube.

12. The spray gun of claim 1, wherein said electrode comprises a plurality of wires and said tips form part of said wires.

13. The spray gun of claim 12, wherein said inner tube has substantially radially extending openings for said wires.

14. The spray gun of claim 1, wherein said electrode consists of metallic sheet material and said tips are prongs of said sheet material.

15. The spray gun of claim 1, further comprising a deflector provided at the front end of said inner tube.

16. The spray gun of claim 15, wherein the front end of said inner tube has a socket and said deflector has a disc-shaped body and a carrier for said body, said carrier being received in said socket and defining with said front end an annular clearance.

17. The spray gun of claim 16, wherein said inner tube has a channel in communication with said socket, and further comprising means for admitting a second flowable material into said channel.

18. The spray gun of claim 16, wherein said carrier includes means for holding said disc-shaped body by snap action.

19. The spray gun of claim 18, wherein said holding means includes a resilient portion of said carrier.

20. The spray gun of claim 16, wherein said front end and said carrier comprise cooperating male and female detent means for releasably holding said carrier in said socket.

21. The spray gun of claim 3, wherein said outer tube has a front end and the front end of said inner tube extends forwardly beyond the front end of said outer tube, said electrode being disposed between the front ends of said inner and outer tubes.

22. The spray gun of claim 21, wherein the tips of said electrode are equidistant from one another in the circumferential direction of said inner tube.

* * * * *